US009885532B1

(12) United States Patent
Morgan

(10) Patent No.: US 9,885,532 B1
(45) Date of Patent: Feb. 6, 2018

(54) TRIGGER ASSEMBLY

(71) Applicant: Ryan David Morgan, Blaine, MN (US)

(72) Inventor: Ryan David Morgan, Blaine, MN (US)

( * ) Notice: Subject to any disclaimer, the term of this patent is extended or adjusted under 35 U.S.C. 154(b) by 4 days.

(21) Appl. No.: 15/162,744

(22) Filed: May 24, 2016

(51) Int. Cl.
*F41A 19/10* (2006.01)

(52) U.S. Cl.
CPC ..... *F41A 19/10* (2013.01)

(58) Field of Classification Search
CPC ..... F41A 19/10
See application file for complete search history.

(56) References Cited

U.S. PATENT DOCUMENTS 4,667,429 A * 5/1987 Perazzi ..... F41A 19/16 42/69.01
4,691,461 A * 9/1987 Behlert ..... F41A 19/16 42/69.01
5,068,991 A * 12/1991 Reed ..... F41C 23/22 42/71.01
2006/0207149 A1* 9/2006 Lazor ..... F41A 19/10 42/69.01
2009/0266348 A1* 10/2009 Yeh ..... F41B 11/00 124/31
2016/0327357 A1* 11/2016 Wheatley ..... F41A 19/10

* cited by examiner

*Primary Examiner* — Stephen Johnson
*Assistant Examiner* — Joshua Semick
(74) *Attorney, Agent, or Firm* — Dave Alan Lingbeck

(57) ABSTRACT

A trigger assembly a trigger member can be interchanged quickly and easily. The trigger assembly includes a support member adapted to be in communication with a gun, and a trigger member in removable communication with the support member.

1 Claim, 4 Drawing Sheets

TRIGGER ASSEMBLY

BACKGROUND OF THE INVENTION

Field of the Invention

The present invention relates to triggers and more particularly pertains to a new trigger assembly for providing easy interchangeable triggers as desired.

Description of the Prior Art

The use of triggers is known in the prior art. More specifically, triggers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a trigger pivoted to a gun frame and formed with a push block; a linkage member having one end formed with a first pivotal part and the other end formed with a second pivotal part. Another prior art includes a firearm trigger assembly including first and second trigger elements having independent pivot points. The first and second trigger elements can also each incorporate rolling contact elements to minimize frictional contact between one another and the remainder of a firing mechanism incorporating the trigger assembly. Also another prior art includes a trigger assembly having two non-coaxial triggers: a slotted primary trigger and a secondary trigger which can pivot into the slot. During an intentional trigger pull, the shooter's finger initially pushes against the secondary trigger until it pivots and nestles within the primary trigger's slot. In addition, another prior art includes a semi-automatic Colt 1911 pistol's conventional trigger mechanism replaced with a lever system comprised essentially of a trigger, a trigger support shoe, and a stirrup which system requires minimal force and trigger travel to fire the pistol. Further, another prior art includes a trigger for a center grip bolt action handgun with single or two stage trigger pull and adjustable sear engagement. The trigger mechanism includes a trigger to actuate a cam assembly with two adjustable contact points that progressively engage a sear release. Yet, another prior art includes a double trigger arrangement including a means for moving a contact point between a front pivot trigger and the heel or face portion of a cooperating slide trigger so that the mechanical advantage between the first trigger and the firing mechanism can be varied. While these devices fulfill their respective, particular objectives and requirements, the aforementioned patents do not disclose a new trigger assembly.

SUMMARY OF THE INVENTION

The general purpose of the present invention, which will be described subsequently in greater detail, is to provide a new trigger assembly which has many of the advantages of the triggers mentioned heretofore and many novel features that result in a new trigger assembly which is not anticipated, rendered obvious, suggested, or even implied by any of the prior art triggers, either alone or in any combination thereof. The present invention includes a support member adapted to be in communication with a gun, and a trigger member in removable communication with the support member. None of the prior art includes the combination of the elements of the present invention.

There has thus been outlined, rather broadly, the more important features of the trigger assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new trigger assembly which has many of the advantages of the triggers mentioned heretofore and many novel features that result in a new trigger assembly which is not anticipated, rendered obvious, suggested, or even implied by any of the prior art triggers, either alone or in any combination thereof.

Still another object of the present invention is to provide a new trigger assembly which can be interchanged easily and quickly as desired.

Still yet another object of the present invention is to provide a new trigger assembly which weighs less and is more aesthetically appealing.

Even still another object of the present invention is to provide a new trigger assembly that costs less than one piece triggers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
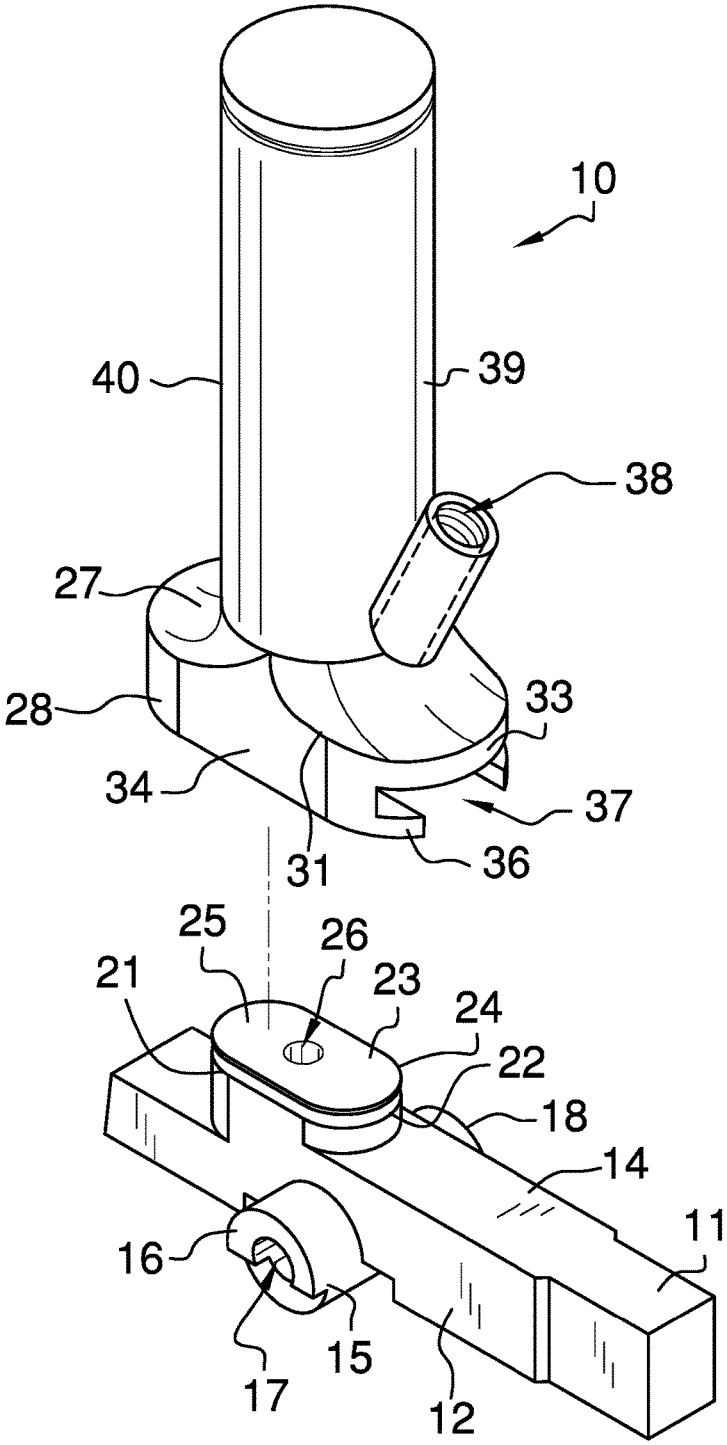
FIG. 1 is a top exploded perspective view of a new trigger assembly according to the present invention.

With reference now to the drawings, and in particular to FIGS. 1 through 4 thereof, a new trigger assembly embodying the principles and concepts of the present invention and generally designated by the reference numeral 10 will be described.

As best illustrated in FIGS. 1 through 4, the trigger assembly 10 may generally comprise a support member 11 adapted to be in communication with a gun 42, and a trigger member 27 in removable communication with the support member 11.

Figure 2:
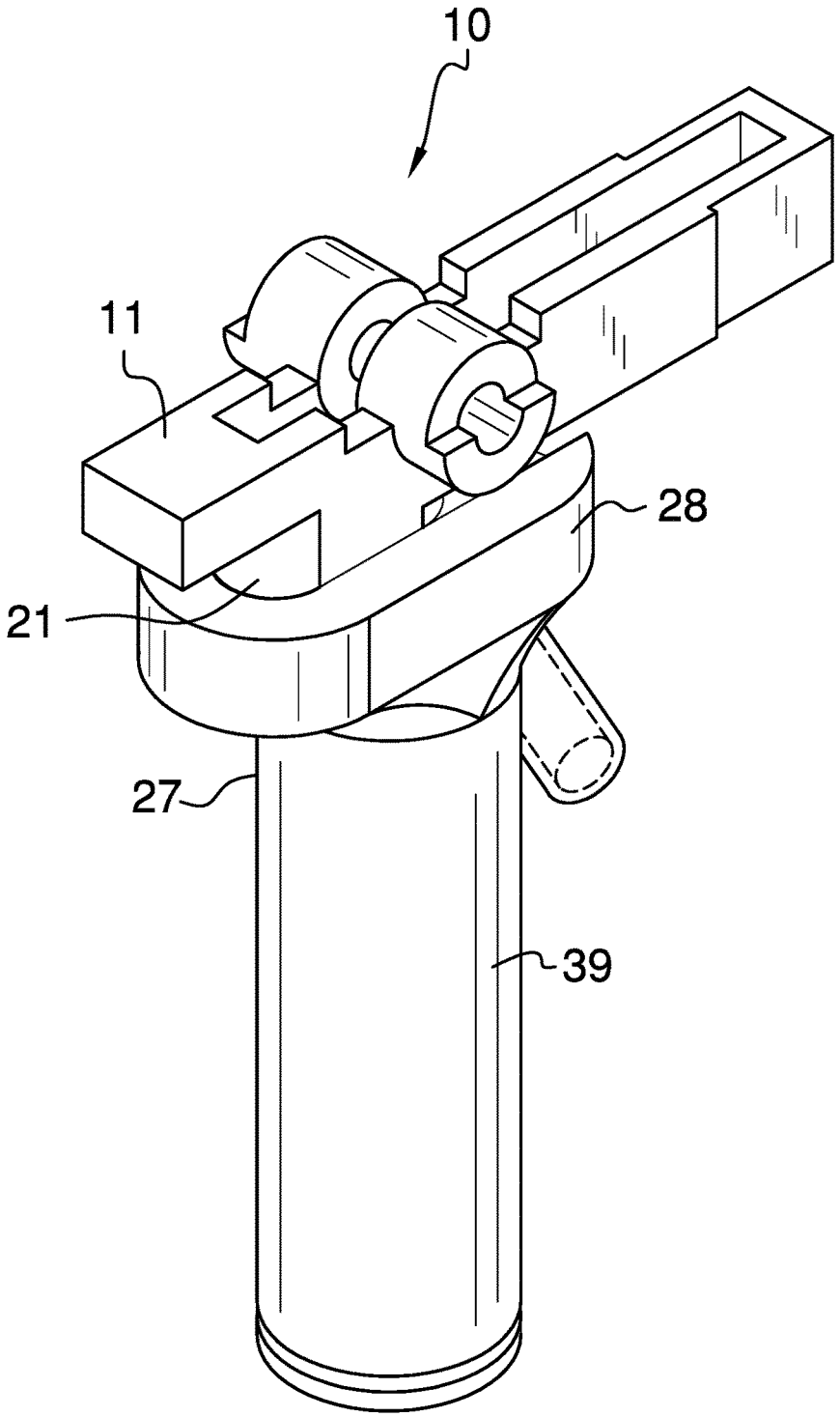
FIG. 2 is a perspective view of the present invention.
Figure 3:
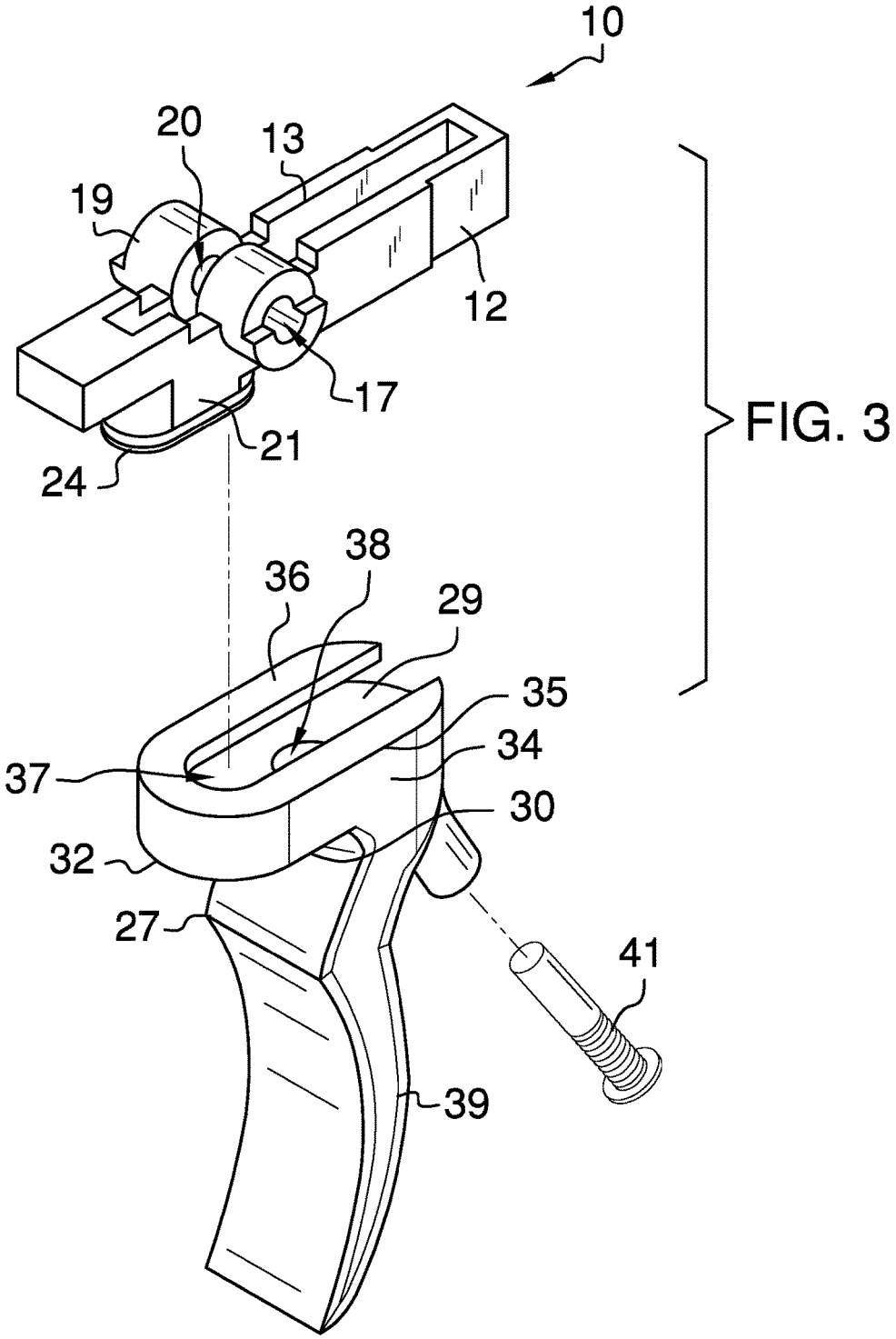
FIG. 3 is a bottom exploded perspective view of a second embodiment of the present invention.

As shown in FIGS. 1-3, the support member 11 may include an elongate body 12 having a top 13, a bottom 14 and gun coupling locations 15, 18. The gun coupling locations 15, 18 may include cylindrical portions 16, 19 with bores 17, 20 extending therethrough. The cylindrical portions 16, 19 may be spaced apart with longitudinal axes of the bores 17, 20 in alignment with one another and perpendicular to the elongate body 12. The support member 11 may also include a boss 21 integrally depending from the bottom 14 of the elongate body 12 and having a side wall 22 and a bottom 23 with a bore 26 disposed in the bottom 23 of the boss 21. The boss 21 may have a flange 24 conventionally disposed thereabout at the bottom 23 of the boss 21 and extending outwardly generally perpendicular to the side wall 22 of the boss 21. The flange 24 has a bottom surface 25 which is coplanar with the bottom 23 of the boss 21.

As illustrated in FIGS. 1-3, the trigger member 27 may include a coupling portion 28 removably supported upon the flange 24 of the boss 21 and may also include a lever portion 39 integrally connected to the coupling portion 28 and having a side wall 40. The coupling portion 28 may include a bottom wall 29 having side edges 30, 31 and opposed end edges 32, 33, and may also include a side wall 34 conventionally and integrally disposed along the side edges 30, 31 and one of the opposed end edges 32 and extending upwardly from the bottom wall 29. The coupling portion 28 may further include a flange 36 conventionally and integrally disposed upon a top edge 35 of the side wall 34 and extending inwardly of the coupling portion 28 and spaced above and parallel to the bottom wall 29 forming a channel 37 therebetween for receiving the flange 24 and the bottom portion 24 of the boss 21. The flange 24 of the support member 11 may be removably received between the flange 36 and the bottom wall 29 of the coupling portion 28 with the flange 36 of the coupling portion 28 engaging the flange 24 of the support member 11. The boss 21 may be removably disposed upon the bottom wall 29 of the coupling portion 28 with the bottom 23 of the boss 21 facing the bottom wall 29 of the coupling portion 28. The trigger member 27 may include a threaded bore 38 extending through the bottom wall 29 of coupling portion 28 and through the side wall 40 of the lever portion 39. The trigger assembly 10 may further include a stopper 41 threaded in the threaded bore 38 through the side wall 40 of the lever portion 39 and extending into the bore 20 in the boss 21 to secure the trigger member 27 to the support member 11.

Figure 4:
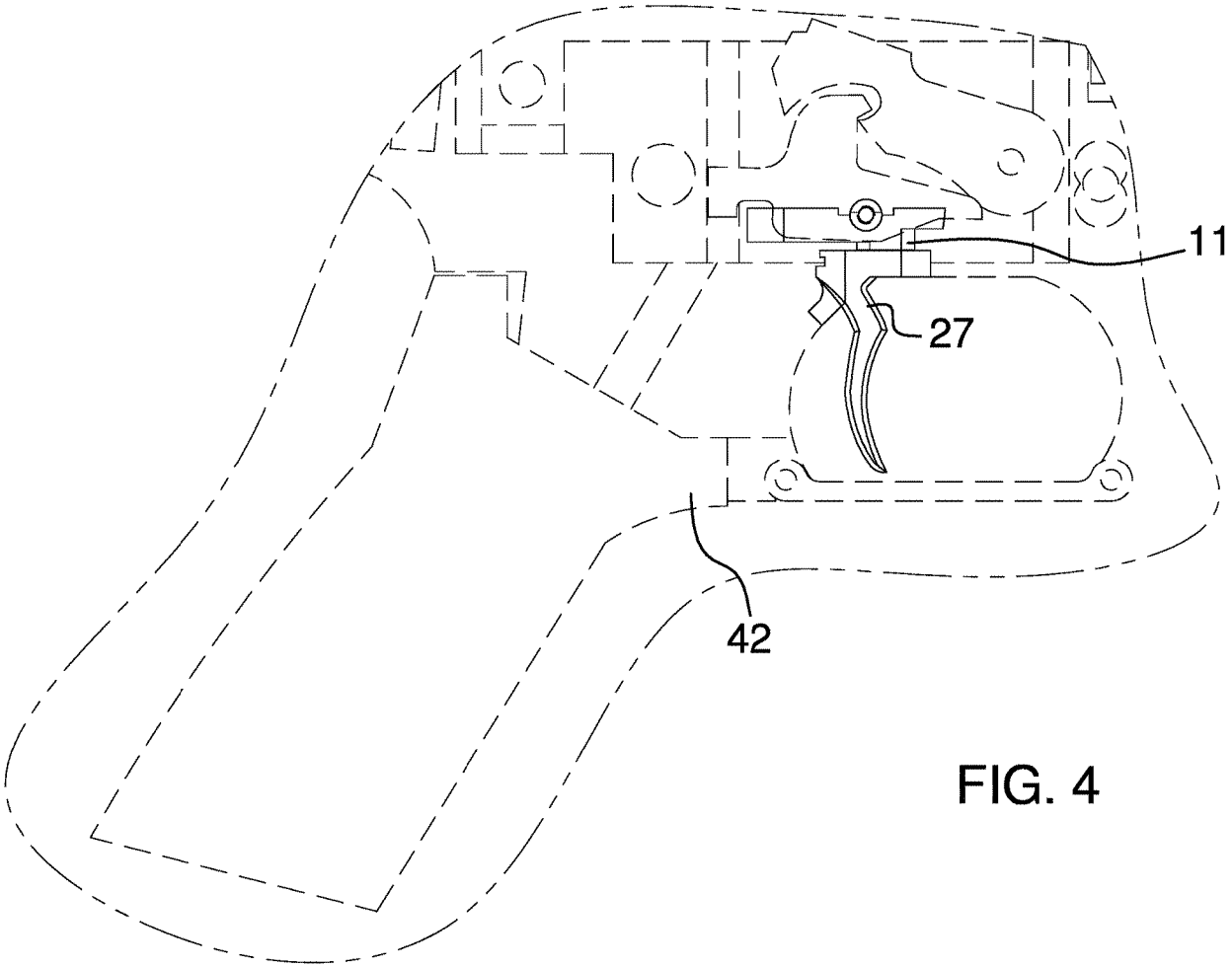
FIG. 4 is a side elevation view of the second embodiment of the present invention.

As shown in FIG. 4, the support member 11 may be conventionally coupled to the gun 42. The trigger member 27 may be securely and removably secured to the support member 11. The flange 24 of the support member 11 may be removably and engageably received in the channel 37. The stopper 41 may be threaded in the bore 38 of the trigger member 27 and extended into the bore 17 of the support member 11 to secure the trigger member 27 to the support member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the trigger assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trigger assembly comprising:

a support member adapted to be in communication with a gun, the support member comprising an elongate body and a boss, the elongate body having a top, a bottom and gun coupling locations, the boss depending from the bottom of the elongate body and having a side wall and a bottom with a recess disposed in the bottom of the boss, a flange encircling the bottom of the boss and extending outwardly generally perpendicular to the side wall of the boss;

a trigger member in removable communication with the support member, the trigger member comprising a lever portion and a coupling portion, the lever portion integrally connected to the coupling portion, the coupling portion including a bottom wall having side edges and opposed end edges, a side wall disposed along the side edges and one of the end edges and extending upwardly from the bottom wall, a flange disposed along a length of the side wall and upon a top edge of the side wall and extending inwardly and spaced above and parallel to the bottom wall forming a channel therebetween for receiving the flange of the bottom of the boss, and a threaded through hole in the coupling portion, the threaded through hole positioned adjacent the recess when the trigger member is seated on the support member; and a stopper received in the threaded through hole and configured to seat against the recess to secure the trigger member to the support member.

* * * * *